US007753168B2

(12) United States Patent
Hara et al.

(10) Patent No.: US 7,753,168 B2
(45) Date of Patent: Jul. 13, 2010

(54) MUFFLER

(75) Inventors: Takeshi Hara, Nissin (JP); Hideyuki Komitsu, Toyota (JP); Masayuki Sudo, Nukata-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/227,117

(22) PCT Filed: May 16, 2007

(86) PCT No.: PCT/IB2007/001277

§ 371 (c)(1),
(2), (4) Date: Nov. 7, 2008

(87) PCT Pub. No.: WO2007/135521

PCT Pub. Date: Nov. 29, 2007

(65) Prior Publication Data

US 2009/0229912 A1 Sep. 17, 2009

(30) Foreign Application Priority Data

May 18, 2006 (JP) ..... 2006-139206

(51) Int. Cl.
*F01N 1/00* (2006.01)
*F01N 1/08* (2006.01)
*F01N 1/16* (2006.01)

(52) U.S. Cl. ..... 181/254; 181/237; 181/265; 181/272; 60/322

(58) Field of Classification Search ..... 181/254, 181/237, 265, 272; 60/322
See application file for complete search history.

(56) References Cited

U.S. PATENT DOCUMENTS

| | | | | | |
|---|---|---|---|---|---|
| 4,244,442 | A * | 1/1981 | Scarton et al. | ..... | 181/230 |
| 4,971,166 | A * | 11/1990 | Hase | ..... | 181/254 |
| 5,614,699 | A * | 3/1997 | Yashiro et al. | ..... | 181/254 |
| 5,723,827 | A * | 3/1998 | Sasaki et al. | ..... | 181/237 |
| 5,801,343 | A * | 9/1998 | Suzuki et al. | ..... | 181/254 |
| 5,984,045 | A * | 11/1999 | Maeda et al. | ..... | 181/254 |
| 6,167,699 | B1 * | 1/2001 | Johnston et al. | ..... | 60/304 |
| 6,173,808 | B1 * | 1/2001 | Maeda et al. | ..... | 181/254 |
| 6,176,347 | B1 * | 1/2001 | Chae et al. | ..... | 181/254 |

(Continued)

FOREIGN PATENT DOCUMENTS

JP A-57-102508 6/1982

(Continued)

*Primary Examiner*—Jeffrey Donels
*Assistant Examiner*—Christina Russell
(74) *Attorney, Agent, or Firm*—Oliff & Berridge, PLC

(57) ABSTRACT

A muffler has a casing with a plurality of sound-muffling chambers, exhaust pipes that pass through at least two sound-muffling chambers and to pass through exhaust from an engine, a plurality of apertures provided in each exhaust pipe, and a plurality of valves provided in each of the apertures. In this muffler, the plurality of apertures are provided at the locations at which an exhaust flow from one aperture and an exhaust flow from another aperture do not interfere with each other. When there are two apertures, the apertures are provided at positions in the exhaust pipes at which the apertures do not face each other. For this reason, by avoiding interference between exhaust flows from the two apertures, it is possible to suppress an abnormal sound caused by the interference.

16 Claims, 9 Drawing Sheets

U.S. PATENT DOCUMENTS

| | | | | |
|---|---|---|---|---|
| 6,189,650 | B1 * | 2/2001 | Inuzuka et al. | 181/254 |
| 6,338,246 | B2 * | 1/2002 | Eguchi et al. | 60/324 |
| 6,581,721 | B2 * | 6/2003 | Nagai et al. | 181/237 |
| 6,915,876 | B2 * | 7/2005 | Ciray | 181/219 |
| 7,063,182 | B2 * | 6/2006 | Proctor | 181/268 |
| 7,104,359 | B1 * | 9/2006 | Zelinski | 181/264 |
| 7,240,768 | B2 * | 7/2007 | Sageman | 181/237 |
| 7,347,046 | B2 * | 3/2008 | Ishimoto et al. | 60/312 |
| 7,426,979 | B2 * | 9/2008 | Nagai | 181/237 |
| 7,562,741 | B2 * | 7/2009 | Winklel et al. | 181/239 |
| 7,575,096 | B2 * | 8/2009 | Arbuckle et al. | 181/253 |
| 2002/0033302 | A1 | 3/2002 | Kaneko et al. | |
| 2003/0005688 | A1 | 1/2003 | Bassani | |
| 2005/0061580 | A1 | 3/2005 | Wiemeler et al. | |
| 2006/0037814 | A1 | 2/2006 | Mabuchi et al. | |
| 2008/0245605 | A1 * | 10/2008 | Maeda et al. | 181/254 |

FOREIGN PATENT DOCUMENTS

| | | | |
|---|---|---|---|
| JP | A-6-88514 | | 3/1994 |
| JP | 2006144707 A | * | 6/2006 |

* cited by examiner

MUFFLER

BACKGROUND OF THE INVENTION

1. Field of the Invention

The present invention relates to muffler that reduces the exhaust noise of an engine.

2. Description of the Related Art

A conventional muffler reduces the exhaust noise of an engine may include, for example, a casing having a plurality of sound-muffling chambers, and an exhaust pipe disposed to pass through over at least two sound-muffling chambers. The engine exhaust is guided in the muffler by the exhaust pipe and each time the exhaust passes through a sound-muffling chamber the exhaust noise is successively reduced. The more times the exhaust passes through the sound-muffling chamber, the more the exhaust noise is reduced, and the greater is the sound-muffling performance. On the other hand, when the engine is rotating at a high speed, at which the exhaust flow amount increases, an increase in the pressure loss reduces the exhaust efficiency, and affects the engine output.

Given the above, the muffler described in the Japanese Patent Application Publication No. JP-A-2001-885514 provides an aperture in the exhaust pipe, and also provides an valve that opens and closes the aperture. By driving the valve to open and close the valve, the sound-muffling chamber is bypassed in the exhaust. With this muffler, the valve is closed when the exhaust flow amount is small, such as when the engine is operating at a low rpm. The number of times the exhaust passes through the sound-muffling chamber is large and the exhaust noise is reduced, thereby improving the sound-muffling performance.

In contrast, the valve is opened when the exhaust flow amount is large, such as when the engine is operating at a high rpm. The opening of the valve causes the exhaust to flow through a flow passage that is different from when the valve is closed. The exhaust is exhausted from the casing after passing through a fewer number of sound-muffling chambers than when the exhaust flow amount is small. This arrangement suppresses an increase in the pressure loss in the muffler, thereby improving the exhaust efficiency at high engine rpm.

However, if the approach described in the Japanese Patent Application Publication No. JP-A-2001-88514 is applied to a muffler having two exhaust pipes within a casing, such as in a dual exhaust pipe muffler, there is concern regarding the following problem. Specifically, if an aperture and an valve is provided in the wall of each exhaust pipe, when both valves are open, exhaust flowing from both apertures may interfere with each other to cause an abnormal sound. The resulting abnormal sound hinders the sound-muffling effect of the muffler.

The same type of problem can occur in a muffler having a plurality of apertures in one and the same exhaust pipe, and in a muffler having three or more exhaust pipes within a casing.

SUMMARY OF THE INVENTION

The present invention provides a muffler capable of suppressing the generation of an abnormal sound caused by interference among exhaust flows from a plurality of exhaust pipes.

A first aspect of the present invention is a muffler having a plurality of sound-muffling chambers enclosing in a casing, an exhaust pipe that passed through at least two of the plurality of sound-muffling chambers and to pass through exhaust from an engine, a plurality of apertures provided in the exhaust pipe that open into one of the plurality of sound-muffling chambers, the one sound-muffling chamber being the same for the plurality of apertures. In this muffler, the opening and closing of the valves switches the exhaust flow passage, and the plurality of apertures are provided at the locations at which an exhaust flow from a first aperture of the plurality of apertures and an exhaust flow from a second aperture of the plurality of apertures do not interfere with each other.

A second aspect of the present invention is a muffler having a plurality of sound-muffling chambers enclosed in a casing, an exhaust pipe that passes through at least two of the plurality of sound-muffling chambers and to pass through exhaust from an engine, a plurality of apertures provided in the exhaust pipe that open into one of the plurality of sound-muffling chambers; and first and second valves, each of which is provided at each aperture. In this muffler, the first valve and the second valve open or closed at different times.

In the first and second aspect, in the condition in which one aperture and another aperture are each blocked by the respective valves, the exhaust from the engine flows downstream along the exhaust pipe without flowing out from the apertures.

When the one aperture is opened by the opening of a valve, the exhaust flowing in the exhaust pipe can flow out from the aperture into a sound-muffling chamber. In the same manner, when the other aperture is opened by the opening of a valve, exhaust flowing in the exhaust pipe can flow out from that aperture into the sound-muffling chamber. In this manner, the exhaust can flow through flow passages that are different, depending on whether the apertures are open or blocked.

According to the first aspect, when both valves are opened and both apertures are open, although exhaust flows out via the apertures into a common sound-muffling chamber, it is unlikely that mutual interference between the flows of exhaust from the two apertures occurs, and an abnormal sound due to this interference is suppressed.

According to the second aspect, when a first valve provided in the other aperture is closed, for example, the second valve provided in the one aperture is opened. During this period of time, exhaust does not flow out from the other aperture into the sound-muffling chamber, and flows into the sound-muffling chamber from only the one aperture. For this reason, during this period of time, it is unlikely that mutual interference between the flows of exhaust from the two apertures occurs, and an abnormal sound due to this interference is suppressed.

In the first aspect, the first aperture may be oriented so that it does not directly face the second aperture. By adopting this constitution, with the opening of an valve the exhaust flowing in the exhaust pipe flows out from the first aperture into the sound-muffling chamber and also from the second aperture in the sound-muffling chamber. The first aperture and the second aperture are provided in the exhaust pipes so that they do not face each other, and the second aperture is not disposed in the flow passage of exhaust flowing out of the first aperture. For this reason, in the case in which the plurality of apertures is formed by two apertures, it is possible to minimize the possibility that mutual interference between the exhaust flows from the two apertures will occur.

In the second aspect, the time period over which the first valve is open may not overlap with the time period that the second valve is open.

By adopting the above-noted constitution, when a first valve is open, a second valve is closed, and when the first valve is closed, the second valve is open. For this reason, when exhaust is flowing out from one aperture into the sound-muffling chamber, exhaust does not flow out from the other aperture into the sound-muffling chamber. The reverse condition also can occur. Therefore, regardless of the positional relationship of one aperture to the other aperture, even if two apertures face each other, for example, it is possible to minimize the possibility that mutual interference between the exhaust flows from the two apertures will occur.

In the first and second aspects, elastic bodies may be used to close the valves.

By adopting the foregoing constitution, the valves are opened and closed in response to the pressure of the exhaust flowing in the exhaust pipes. When the force of the exhaust attempting to open the valve is smaller than an urging force of the elastic body, the valve is closed. However, if the force of the exhaust attempting to open the valve is at least as large as the urging force of the elastic body, the valve is opened. By using the exhaust pressure in this manner, it is possible to operate (open and close) that valve using a simple configuration in which an elastic body urges the valve to the side that blocks the aperture.

The above-noted elastic bodies of the valves may have mutually different coefficients of elasticity. By adopting this constitution, in the case in which the exhaust pressure increases from the condition in which both of the valves are closed, first the valve that is urged by the elastic body having a small coefficient of elasticity switches to the opened condition. After that, the other valve, which is urged by the elastic body having a large coefficient of elasticity is switched to the opened condition. In reverse, if the exhaust pressure decreases from the condition in which both the valves are open, first the valve that is urged by the elastic body having the large coefficient of elasticity switches to the closed condition. After that, the other valve, which is urged by the elastic body having the small coefficient of elasticity, switches to the closed condition. In either case, a period of time occurs during which one aperture is open and the other aperture is blocked. During this period of time, exhaust from the other aperture does not flow out into the sound-muffling chamber, and the exhaust from only the one aperture flows out into the sound-muffling chamber.

In the first aspect, by using elastic bodies having mutually different coefficients of elasticity, it is possible to avoid interference between exhaust flowing from one aperture and exhaust flowing from another aperture. For this reason, compared to the case in which the valves switch operating conditions at the same time, more reliable suppression of exhaust interference is achieved.

In the second aspect, by using elastic bodies having mutually different coefficients of elasticity, it is possible to switch the operating condition of the valve provided at one aperture at a timing that is different than that of the valve provided at another aperture, thereby enabling suppression an abnormal sound caused by interference between the exhaust flows from the apertures.

A third aspect of the present invention is a muffler having a plurality of sound-muffling chambers enclosed in a casing, a plurality of exhaust pipes that pass through at least two of the plurality of sound-muffling chambers and to pass through exhaust from an engine, an aperture provided in each exhaust pipe that opens into one of the plurality of sound-muffling chambers, wherein each aperture opens into the same sound-muffling chamber, and a valve, provided at each aperture. In this muffler, the opening and closing of the valves switches the exhaust flow passage, and the plurality of apertures are provided at the locations at which an exhaust flow from a first aperture of the plurality of apertures and an exhaust flow from a second aperture of the plurality of apertures do not interfere with each other.

A fourth aspect of the present invention is a muffler a plurality of sound-muffling chambers enclosed in a casing, an exhaust pipe that pass through at least two of the plurality of sound-muffling chambers and to pass through exhaust from an engine, an aperture provided in each exhaust pipe that opens into one of the plurality of sound-muffling chambers, wherein each aperture opens into the same sound-muffling chamber; and a valve, provided at each aperture. In this muffler, a first valve and a second valve of the plurality of valves open or close at different times.

In the third and fourth aspects at least two exhaust pipes may be provided, wherein each of at least exhaust pipes are provided in the wall of each exhaust pipe. In this case, when the apertures provided in the pipe walls of each exhaust pipe are opened by opening the valve, the exhaust flowing midway in the exhaust pipes can flow out from the aperture into the sound-muffling chamber.

Even in a muffler having at least two exhaust pipes, therefore, by providing each aperture at locations that do not mutually interfere with each other, as in the third aspect, it is possible to avoid the problem of an abnormal sound being generated by interference between the flows of exhaust from each aperture.

Additionally, even in a muffler having at least two exhaust pipes, the use of the first valve provided at one aperture and the second valve provided at another aperture that are not opened or closed simultaneously makes it possible to avoid the problem of an abnormal sound being generated by the mutual interference between the flows of exhaust from the plurality of apertures.

A fifth aspect of the present invention is a muffler having a plurality of sound-muffling chambers enclosed in a casing, at least one exhaust pipe that passes through at least two of the plurality of sound-muffling chambers, an aperture, provided in each portion of the at least one exhaust pipe present in one of the plurality of sound-muffling chambers, wherein each aperture opens into the same sound-muffling chamber, and a valve, provided at each aperture. In this muffler, the plurality of apertures are provided at the locations where an exhaust flow from a first aperture of the plurality of apertures and an exhaust flow from a second aperture of the plurality of apertures do not interfere with each other.

A sixth aspect of the present invention is a muffler having a plurality of sound-muffling chambers enclosed in a casing, at least one exhaust pipe that passes through at least two of the plurality of sound-muffling chambers, an aperture, provided in each portion of the at least one exhaust pipe present in one of the plurality of sound-muffling chambers, wherein each aperture opens into the same sound-muffling chamber; and a valve, provided at each aperture. In this muffler, a first valve and a second valve of the plurality of valves are not opened or closed simultaneously.

BRIEF DESCRIPTION OF THE DRAWINGS

The foregoing and further objects, features, and advantages of the invention will become apparent from the following description of preferred embodiments with reference to the accompanying drawings, wherein like numerals are used to represent like elements, and wherein.

DETAILED DESCRIPTION OF THE PREFERRED EMBODIMENTS

A first embodiment of a muffler according to the present invention provided in the exhaust system of a vehicle is described below, with references made to FIG. 1 through FIG. 5.

An engine having two banks of cylinders, for example a V-type engine, is mounted aboard a vehicle as the drive power source for the vehicle. In this engine, the combusted gas (exhaust gas) generated in combustion chambers of each bank passes successively via constituent members of separate exhaust flow passages, for example exhaust manifolds and catalytic converters and the like, after which it is guided to a muffler. The exhaust flow from each bank merges inside the muffler and flows in the downstream direction of the exhaust.

Figure 1:
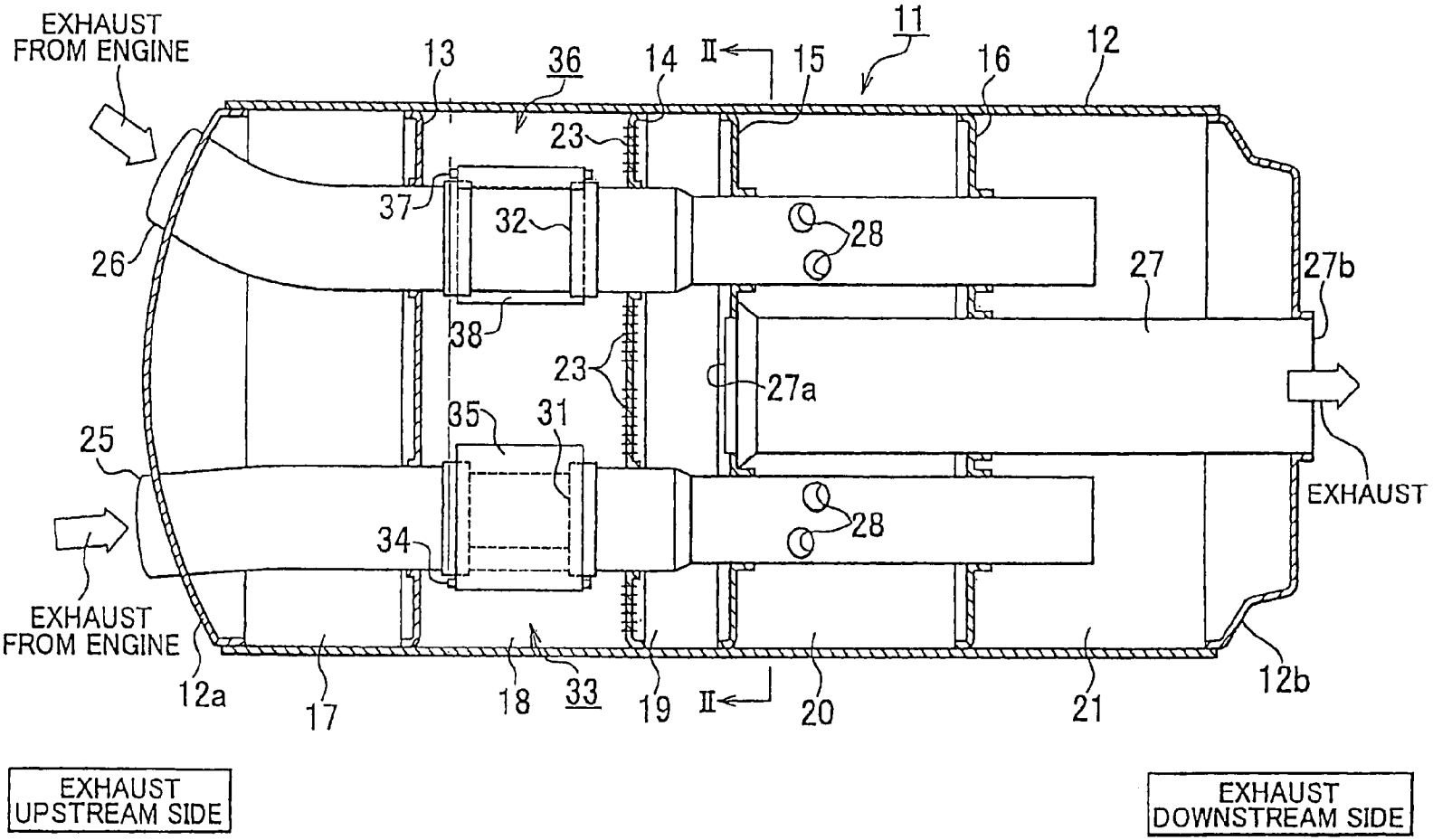
FIG. 1 is a plan cross-sectional view showing the internal configuration of a muffler according to a first embodiment of the present invention.
Figure 2:
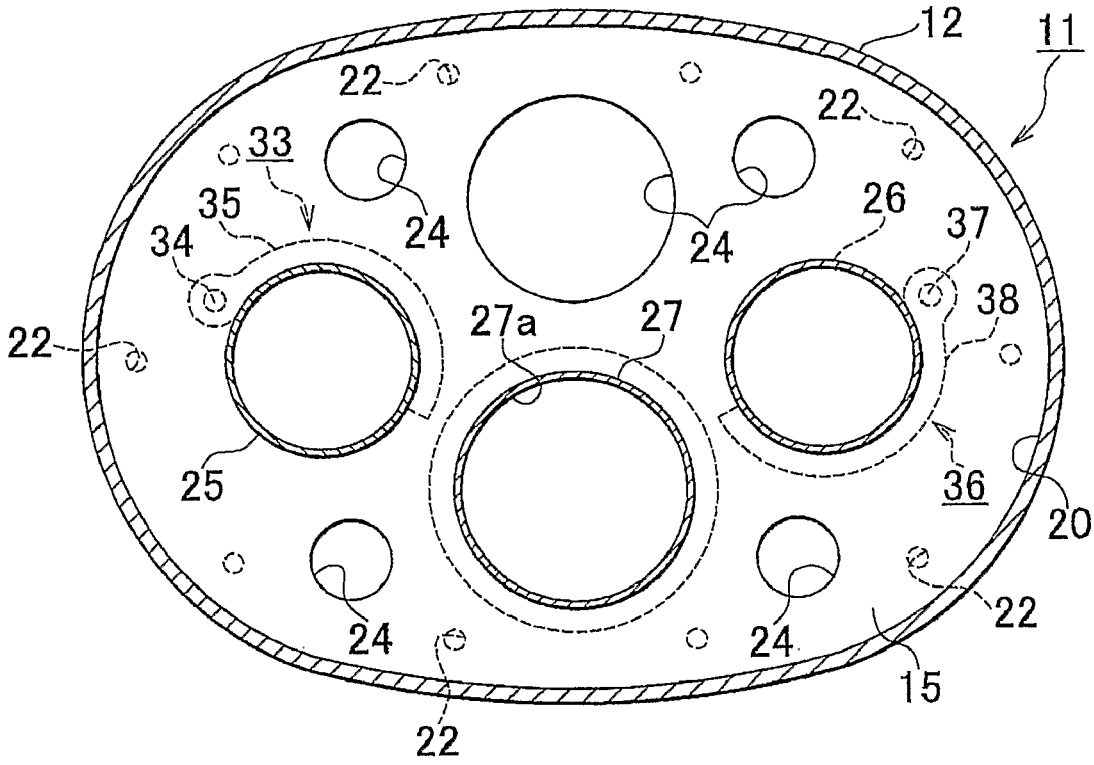
FIG. 2 is a cross-sectional view showing the cross-sectional configuration along the line II-II indicated in FIG. 1.

FIG. 1 shows the cross-sectional configuration cut in the horizontal plane along the direction of flow of the exhaust in the above-noted muffler 11. In this case, the left side of FIG. 1 is the exhaust upstream side, and the right side of FIG. 1 is the exhaust downstream side. The muffler 11 has a casing 12 with the shape of a pipe elongated in the exhaust flow direction, and two walls 12*a*, 12*b* at both ends thereof, which block off the ends. The casing 12 has a substantially elliptical cross-sectional shape in a plane perpendicular to the exhaust flow direction (refer to FIG. 2). The cross-sectional shape is not restricted to this shape, however, and may be a different shape.

Within the casing 12, between the upstream-side wall 12*a* and the downstream-side wall 12*b*, a plurality of separators are provided, which are spaced mutually therebetween. These separators partition the space inside the casing 12 into a plurality of sound-muffling chambers. Although in this embodiment four separators 13 to 16 partition the space inside the casing 12 into five sound-muffling chambers, this is merely exemplary, and variations are possible as appropriate.

Of the plurality of sound-muffling chambers partitioned in this manner, the sound-muffling chamber positioned the most downstream forms a resonance chamber 21, and the other four sound-muffling chambers form expansion chambers 17 to 20. The resonance chamber 21 resonates in a prescribed frequency band in which exhaust is not passed, thereby muffling sound waves in that frequency band. The parameters, such as the volume, of the resonance chamber 21 are set to values that enable reduction of components of the exhaust noise in a particular frequency region, for example, to enable efficient reduction of the exhaust noise in the low-frequency region. Each of the expansion chambers 17 to 20 has a function of reducing the exhaust noise by reducing the exhaust pressure by changing the exhaust volume (expansion).

A plurality of holes 22 (refer to FIG. 2) are provided in the separator 13. The expansion chambers 17, 18 are connected via the holes 22. The separator 14 is formed as a punched metal member. Specifically, the separator 14 has a large number of small-diameter holes 23 formed therein, and the expansion chambers 18, 19 are connected via the holes 23. In FIG. 1, the holes 23 are indicated by short horizontal lines intersecting with the separator 14. Additionally, at a plurality of locations in separator 15, a plurality of holes 24 (refer to FIG. 2) having a diameter larger than that of the holes 23 of the separator 14 are provided. The holes 24 connect between the expansion chambers 19, 20. The separator 16, which is farthest downstream, does not have these holes.

The muffler 11 has a plurality of exhaust pipes. These exhaust pipes are formed by two inlet pipes (a first inlet pipe 25 and a second inlet pipe 26) and one outlet pipe 27. The first inlet pipe 25 is an exhaust pipe for guiding exhaust from one bank of the engine into the casing 12, and the second inlet pipe 26 is an exhaust pipe for guiding exhaust from the other bank of the engine into the casing 12. Both of the inlet pipes 25, 26 have a substantially elliptical cross-sectional shape in a plane perpendicular to the flow direction of the exhaust (refer to FIG. 2). The inlet pipes 25, 26 are disposed with a distance between them in the vehicle width direction (up/down direction in FIG. 1, left/right direction in FIG. 2). Both the inlet pipes 25, 26 are supported by the wall 12*a* and the four separators 13 to 16. In this manner, the inlet pipes 25, 26 are disposed to pass through all of the sound-muffling chambers.

The exhaust downstream end of each of the inlet pipes 25, 26 is open within the resonance chamber 21. For this reason, the exhaust flow from each bank of the engine is guided into the resonance chamber 21 by the inlet pipes 25, 26, and merges within the resonance chamber 21. This configuration has the following advantages. Taking, for example, the case in which each of the independent exhaust passages for each bank of the engine are connected farther upstream from the muffler 11 in the exhaust, that is, the case in which the flows of exhaust from each bank are joined together in a merging pipe, for example, and are subsequently guided into the muffler 11, exhaust interference occurring at the merging part causes an increase in the pressure loss in the exhaust system. With regard to this point, in this embodiment exhaust flows from each bank and are guided into the inlet pipes 25, 26 and causes to merge within the casing 12, which has a larger volume than the volume of merging part of an upstream merging pipe, thereby suppressing an increase in pressure loss in the exhaust system caused by exhaust interference.

A plurality of holes 28 are formed in locations in the walls of the inlet pipes 25, 26 that correspond to the location of the expansion chamber 20. For this reason, part of the exhaust that flows within the inlet pipes 25, 26 can flow out from the holes 28 into the expansion chamber 20.

The outlet pipe 27 is an exhaust pipe for guiding exhaust within the casing 12 downstream. The outlet pipe 27 is supported by the separators 15, 16 and by the wall 12*b*. An exhaust inflow port 27*a* is formed in the outlet pipe 27 as an aperture in the expansion chamber 19. The exhaust downstream end of the outlet pipe 27 is open on the outside of the casing 12 and forms the exhaust outflow port 27*b*.

Figure 3:
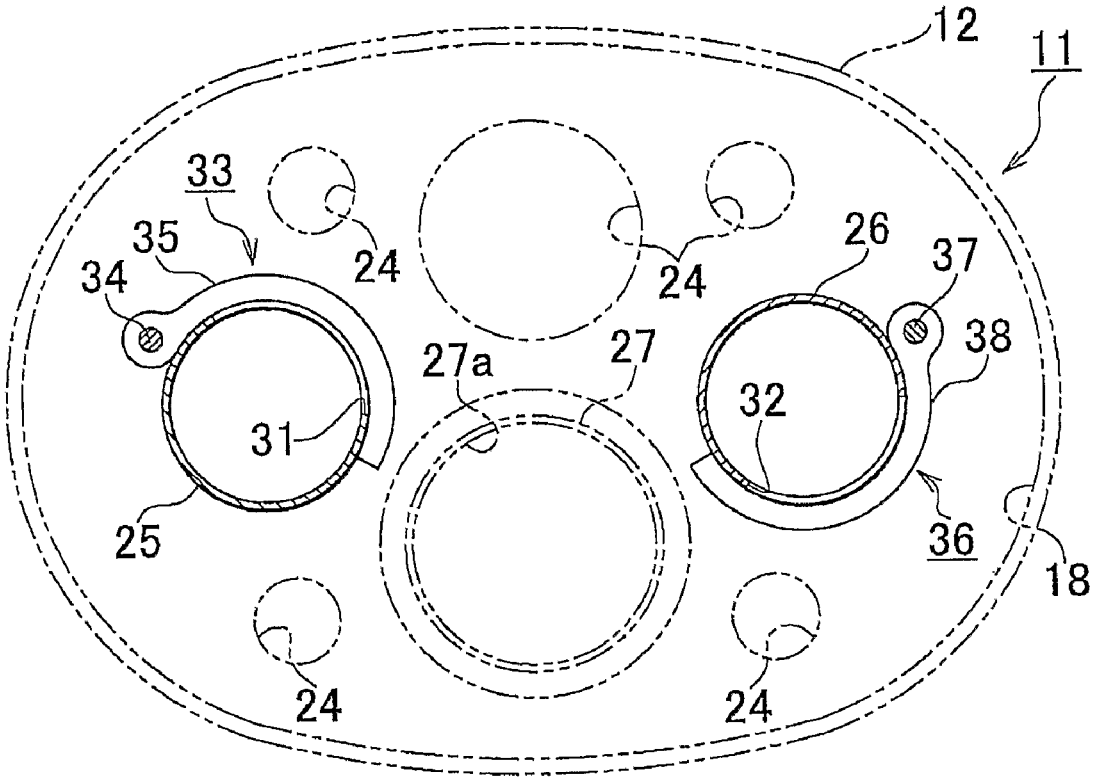
FIG. 3 is a partial cross-sectional view showing the positional relationship between the apertures for each inlet pipe and the valves in FIG. 2.

Additionally, as shown in at least one of FIG. 1 and FIG. 3, one aperture 31, 32 each is formed in the walls of the first inlet pipe 25 and the second inlet pipe 26 so as to cause communication between inside and outside of the pipes within one of the sound-muffling chambers. In this embodiment, the apertures 31, 32 are both provided at locations corresponding to the expansion chamber 18. For this reason, exhaust flowing into the inlet pipes 25, 26 can flow out into the expansion chamber 18 from the apertures 31, 32. The apertures 31, 32 may open into a different sound-muffling chamber from the above-noted sound-muffling chamber 18.

The apertures 31, 32 are formed by cutting out a part of the pipe walls of the inlet pipes 25, 26 in the circumferential direction to form substantially rectangular apertures therein. The apertures 31, 32 are provided at locations in the pipe walls of the corresponding inlet pipes 25, 26 at which the exhaust flow from one aperture 31 (32) does not interfere with the exhaust flow from the other aperture 32 (31). Such locations include (i) locations in the pipe walls which do not face each other in the circumferential direction, (ii) locations in the pipe walls which do not face each other in the exhaust flow direction, and (iii) locations satisfying both conditions (i) and (ii).

In this embodiment, because the length of the expansion chamber 18 in the exhaust flow direction is short, there is a limit to the offsetting of the apertures 31, 32 in the exhaust flow direction to avoid facing of the apertures 31, 32. For this reason, in this embodiment the apertures 31, 32 are provided in the above-noted (i) locations. As shown in FIG. 3, the aperture 31 is provided substantially on the upper half part of the circular cross-section of the first inlet pipe 25 when the cross-section perpendicular to the exhaust flow direction is viewed from the exhaust downstream side. In contrast, the aperture 32 is provided substantially on the lower half part of the circular cross-section of the second inlet pipe 26 when the cross-section is viewed from the exhaust downstream side.

The muffler 11 also has a first opening/closing mechanism 33 for switching the flow passage of exhaust in the first inlet pipe 25 by opening and closing the aperture 31. The first opening/closing mechanism 33 has a shaft 34, a first valve 35, and a spring (not shown) as an elastic body. The muffler 11 has a second opening/closing mechanism 36 for switching the flow passage of exhaust in the second inlet pipe 26 by opening and closing the aperture 32. The second opening/closing mechanism 36 has a shaft 37, a second valve 38, and a spring (not shown) as an elastic body.

The constituent elements of the first opening/closing mechanism 33 and the second opening/closing mechanism 36 (shafts 34, 37, valves 35, 38, and the springs) are described next. Because these elements are common to the first and second opening/closing mechanisms 33, 36, the constituent elements of the first opening/closing mechanism 33 only will be described, and the description of the constituent elements of the second opening/closing mechanism 36 will be omitted.

The shaft 34 in the first opening/closing mechanism 33 is disposed in the vicinity of the aperture 31, in the direction of exhaust flow, at a distance from the outer peripheral surface of the first inlet pipe 25. The shaft 34 is fixed to the first inlet pipe 25 via, for example, a bracket or the like (not shown).

The first valve 35 has a shape and size enabling it to fit over and block the aperture 31 and the surrounding region of the first inlet pipe 25 when the valve is closed. More specifically, the first valve 35 has a diameter slightly larger than that of the first inlet pipe 25, and is shaped as half a cylindrical tube with a length slightly longer than the aperture 31 in the exhaust flow direction. The first valve 35 is rotatably provided on the shaft 34 at one end thereof in the circumferential direction (left direction in FIG. 3). When the first valve 35 is swung about the shaft 34 as a pivot point to the side away from the aperture 31 (counter-clockwise direction in FIG. 3), the aperture 31 is opened. On the other hand, when the first valve 35 is swung about the shaft 34 as a pivot point to the side that approaches the aperture 31 (clockwise direction in FIG. 3), the aperture 31 is blocked when the first inlet pipe 25 is covered by the first valve 35. In this manner, the opening and closing of the first valve 35 opens and closes the aperture 31.

The spring is provided to urge the first valve 35 to swing to the side that blocks the aperture 31, that is, in the valve-closing direction (clockwise direction in FIG. 3) and is, for example, a torsion coil spring. The torsion coil spring is attached to the shaft 34, one end of the spring being fixed to the bracket, the casing 12, or the like, and the other end being fixed to the first valve 35. The pressure of the exhaust flowing in the first inlet pipe 25 is used to open the first valve 35 in opposition to the urging force of the spring. The pressure of the exhaust acts on the first valve 35 via the aperture 31. By this pressure, a force urging the first valve 35 to open is applied to the first valve 35. The first valve 35 is swung to a point at which the urging force of the spring balances with the urging force of the exhaust pressure. If the urging force of the exhaust pressure is smaller than the urging force of the spring, the first valve 35 is closed. In the other hand, if the urging force of the exhaust pressure is at least as large as the urging force of the spring, the first valve 35 is opened.

Figure 5:
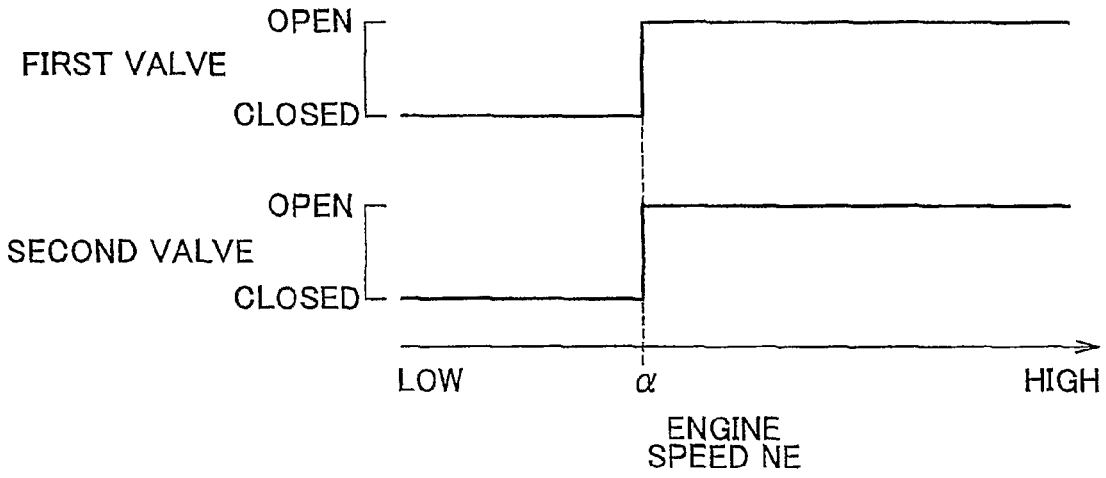
FIG. 5 is a drawing showing the relationship between the engine speed the operating condition of each valve.

The exhaust pressure and the exhaust flow amount are generally proportionally related to each other, as are the exhaust flow amount and the engine speed Ne. When the engine speed Ne is low, the exhaust flow amount is small and the exhaust pressure is low. When the engine speed Ne is high, the exhaust flow amount is large and the exhaust pressure is high. Therefore, although it is dependent as well upon the setting of the urging force (coefficient of elasticity) of the spring, when the engine speed Ne is low and the exhaust pressure is low, the first valve 35 is closed, and when the engine speed Ne is high and the exhaust pressure is high, the first valve 35 is open. Stated differently, the engine speed Ne at which there is a balance between the urging force of the spring and the urging force of the exhaust (exhaust pressure) is the threshold value $\alpha$. As shown in FIG. 5, when the engine speed Ne is in a rotational speed region lower than the threshold value $\alpha$, the urging force of the exhaust is smaller than the urging force of the spring, and the first valve 35 is closed. When the engine speed Ne is in an rotational speed region higher than the threshold value $\alpha$, however, the urging force of the exhaust is greater than that of the spring, and the first valve 35 is opened.

In this embodiment, the spring urging the first valve 35 and the spring urging the second valve 38 have the same coefficient of elasticity. Therefore, assuming the same amount of exhaust flows into each of the inlet pipes 25 and 26 from each bank of the engine, the valves 35 and 38 should open and close with the same timing.

In the first embodiment constituted as described above, the exhaust from one bank of the engine passes through an exhaust manifold, and a catalytic converter and the like, after which it flows into the first inlet pipe 25. In the same manner, the exhaust from the other bank of the engine passes through an exhaust manifold and a catalytic converter or the like, after which it flows into the second inlet pipe 26.

After having flowed into the inlet pipes 25, 26 in this manner, the exhaust, in response to the operating conditions of the valves 35, 38, flows into the following different flow passages. The valves 35, 38 operate (open and close) in response to the engine speed Ne and, more specifically, in response to the relationship of the engine speed Ne and the threshold value $\alpha$, as shown in FIG. 5.

When the engine speed Ne is smaller than the threshold value $\alpha$, the exhaust flow amount is small, the exhaust pressure acting on the valves 35, 38 is low, and the urging force of the exhaust is smaller than the urging force of the springs. As shown in FIG. 3 the valves 35, 38 close and both the apertures 31 and 32 are blocked. For this reason, the exhaust does not flow out from the apertures 31, 32 into the expansion chamber 18. As shown in FIG. 1, exhaust that from upstream of the casing 12 and is guided into the inlet pipes 25, 26 flows into the resonance chamber 21, and flows out to the expansion chamber 20 from the hole 28. The latter exhaust, after flowing from the expansion chamber 20 to the expansion chambers 19, 18, 17 and the like, flows into the outlet pipe 27 from the inflow port 27*a*. The exhaust is guided by outlet pipe 27, and is guided to the exhaust passage downstream from the casing 12 from the outflow port 27*b*. In the exhaust passage, because of a change in volume (expansion) when passing through the expansion chambers 20, 19, and the like, the pressure of the exhaust decreases, and the exhaust noise is reduced. In this manner the sound-muffling performance at a low engine speed is improved.

Figure 4:
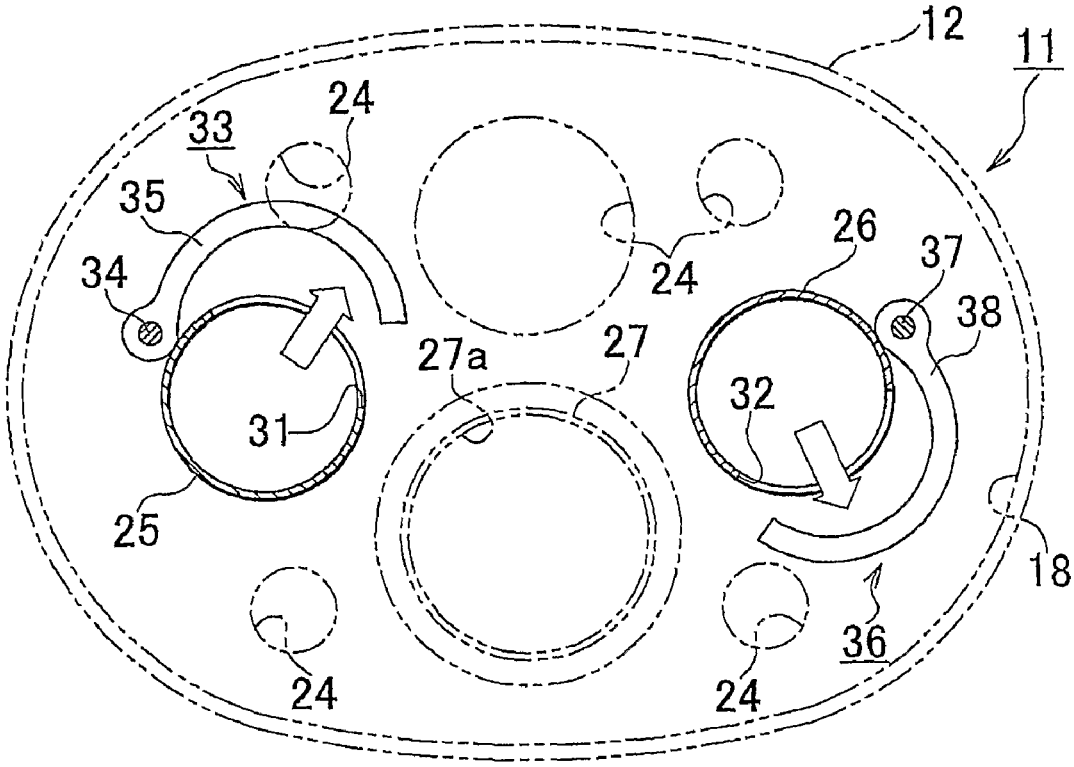
FIG. 4 is a partial cross-sectional view showing the condition in which the valves in FIG. 3 are both open.

When the engine speed Ne is larger than the threshold value α, the exhaust flow amount is large, the exhaust pressure acting on the valves 35, 38 is high, and the urging force of the exhaust is larger than the urging force of the springs. As shown in FIG. 4, the valves 35, 38 open and both the apertures 31 and 32 are opened. The exhaust can flow out via the apertures 31, 32 to the expansion chamber 18. For this reason, the flow passage taken by the exhaust guided inside the inlet pipes 25, 26, in contrast to the flow passage when the valves 35, 38 are closed, is a newly added passage that flows out directly from aperture 31, 32 to the expansion chamber 18. Much of the exhaust flowing through the new flow passage, as shown in FIG. 1, flows from the expansion chamber 18, passing through the expansion chamber 19, and flows into the outlet pipe 27 from the inflow port 27*a*. That is, the exhaust detours around the expansion chamber 20 and, after passing through the expansion chambers 18, 19, flows into the outlet pipe 27 from the inflow pipe 27*a*. Some exhaust also, after flowing out from the apertures 31, 32, flows from the expansion chamber 18 to the expansion chamber 17. The exhaust that flows into the inflow pipe 27*a*, after being guided downstream in the exhaust by the outlet pipe 27, is guided out from the outflow port 27*b* toward the exhaust passage downstream from the casing 12.

Holes 23 are formed at many locations in the separator 14, and the resistance (pressure loss) occurring when the exhaust passes through the holes 23 is small enough to be neglected. Therefore, the pressure loss occurring in the case of the exhaust flowing through the flow passage from the apertures 31, 32 up to the inflow port 27*a* of the outlet pipe 27 is smaller than the pressure loss occurring in the case of the exhaust flowing from the holes 28 of the inlet pipes 25, 26 up to the inflow port 27*a*. Even at a high engine speed, at which the exhaust flow amount is large, an increase in the pressure loss within the casing 12 is suppressed, resulting in an improvement in the exhaust efficiency at a high engine speed.

Additionally, as described above, using a spring urging the first valve 35 and a spring urging the second valve 36 that have the same coefficient of elasticity, the operating conditions of the valves 35, 38 are switched at the same time, as shown in FIG. 5. Accompanying this, the apertures 31, 32 of the inlet pipes 25, 26 are opened and closed at the same time. The exhaust flowing within the first inlet pipe 25, accompanying the opening of the first valve 35, flows out into the expansion chamber 18 via the aperture 31. The exhaust flowing within the second inlet pipe 26, accompanying the opening of the second valve 38, flows out into the expansion chamber 18 via the aperture 32. When this occurs, the direction of outflow of exhaust toward the expansion chamber 18 is determined by the position of opening of the apertures 31, 32 in the circumferential direction of the inlet pipes 25, 26. The direction of outflow of exhaust flowing within the inlet pipes 25, 26, as indicated by the arrows in FIG. 4, is substantially a direction that connects the centers of the inlet pipes 25, 26 with the apertures 31, 32 (that is, the outward radial directions).

In this embodiment the apertures 31, 32 are provided at locations on the inlet pipes 25, 26 so that they do not face each other. These are locations at which the exhaust flow from one aperture 31 does not interfere with the exhaust flow from the other aperture 32. The position of the other aperture 32 does not lie on the flow passage of the exhaust flowing out from the one aperture 31. Therefore, the phenomenon of mutual interference between exhaust flowing out from the aperture 31 and the exhaust flowing out from the aperture 32 does not occur.

The first embodiment described above achieves the following four effects.

(1) A plurality of apertures 31, 32 are provided at locations at which the exhaust flowing out from one aperture 31 does not interfere with the exhaust flowing out from the other aperture 32. For this reason, when the valves 35, 38 are open and the corresponding apertures 31, 32 are opened, although the exhaust in each inlet pipe 25, 26 flows via the apertures 31, 32 to the common expansion chamber 18, it is possible to suppress mutual interference between the exhaust flows and the problem of generation of an abnormal sound. It is therefore possible to suppress the problem of hindering the sound-muffling effect, and to reduce the exhaust pressure loss accompanying exhaust interference.

(2) The two apertures 31, 32 provide a plurality of apertures. Locations in the pipe walls of the exhaust pipes (the inlet pipes 25, 26) that they do not face each other are set as locations at which the exhausts from the apertures 31, 32 do not mutually interfere. By providing the apertures 31, 32 at the locations set in this manner, the other aperture 32 is not positioned in the flow passage of the exhaust flowing out from the one aperture 31. For this reason, the phenomenon of the exhaust flowing out from the one aperture 31 interfering with the exhaust flowing out from the other aperture 32 is made difficult to occur, thereby achieving the foregoing effect (1) with further reliability.

(3) In the muffler 11 having a plurality of inlet pipes 25, 26, the apertures 31, 32 are provided in the pipe walls of the inlet pipes 25, 26 and the apertures 31, 32 provide a plurality of apertures. By opening the apertures 31, 32 by opening the valves 35, 38, exhaust flowing midway in the inlet pipes 25, 26 is caused to flow out into the expansion chamber 18 from the apertures 31, 32. Even in this type of muffler 11, therefore, by providing the apertures 31, 32 at locations at which exhaust interferences is not caused, it is possible to achieve the effect noted above at (1).

(4) The valves 35, 38 are swingably supported by the shafts 34, 37, and the valves 35, 38 are urged by elastic bodies (springs) toward the side of blocking the apertures 31, 32. By the relationship in magnitude between the urging force of the exhaust pressure acting on the valves 35, 38 and the urging force of the springs, the valves 35, 38 are operated (opened and closed). By using the exhaust pressure in this manner, it is possible to operate (open and close) the valves 35, 38 by using a simple mechanism that utilizes elastic bodies (springs) that urge the valves 35, 38 toward the side that blocks the apertures 31, 32. This eliminates the need to provide a driving mechanism or actuator to open and close the valves 35, 38, thereby preventing an increase in cost and weight.

A second embodiment of the present invention is described below with reference made to FIG. 1, and FIG. 6 to FIG. 8.

The second embodiment is different from the first embodiment in that, in order to suppress interference between the flows of exhaust from the apertures 31, 32, the timing of the switching of the operating condition of one of the first valve 35 and the second valve 38 is done at a different timing from that of the other valve.

More specifically, the setting of the engine speed Ne when there is balance between the urging force of the spring and the urging force of the exhaust (exhaust pressure) as the threshold value $\alpha$ is the same as described above. In the first embodiment the same threshold value $\alpha$ is set for both the valves 35 and 38, and the valves 35, 38 are closed when the engine speed Ne is lower than the threshold value $\alpha$ and the valves 35, 38 are opened when the engine speed Ne is a or greater. With this arrangement, the operating condition of the valves 35, 38 are switched at the same time, in response to a change in the engine speed Ne.

In contrast, in the second embodiment the threshold value with regard to the first valve 35 and the threshold value with regard to the second valve 38 are set to different values. If the former threshold value is $\alpha$1 and the latter threshold value is $\alpha$2, the threshold values of $\alpha$1 and $\alpha$2 are set to satisfy the relationship $\alpha 1<\alpha 2$.

In order to implement the above relationship, in the second embodiment elastic bodies (springs) having mutually differing coefficients of elasticity are used as the springs. If the coefficient of elasticity of the spring that urges the first valve 35 is k1, and the coefficient of elasticity of the spring that urges the second valve 38 is k2, two types of springs are used that have coefficients of elasticity satisfying the relationship $k1<k2$.

Figure 6:
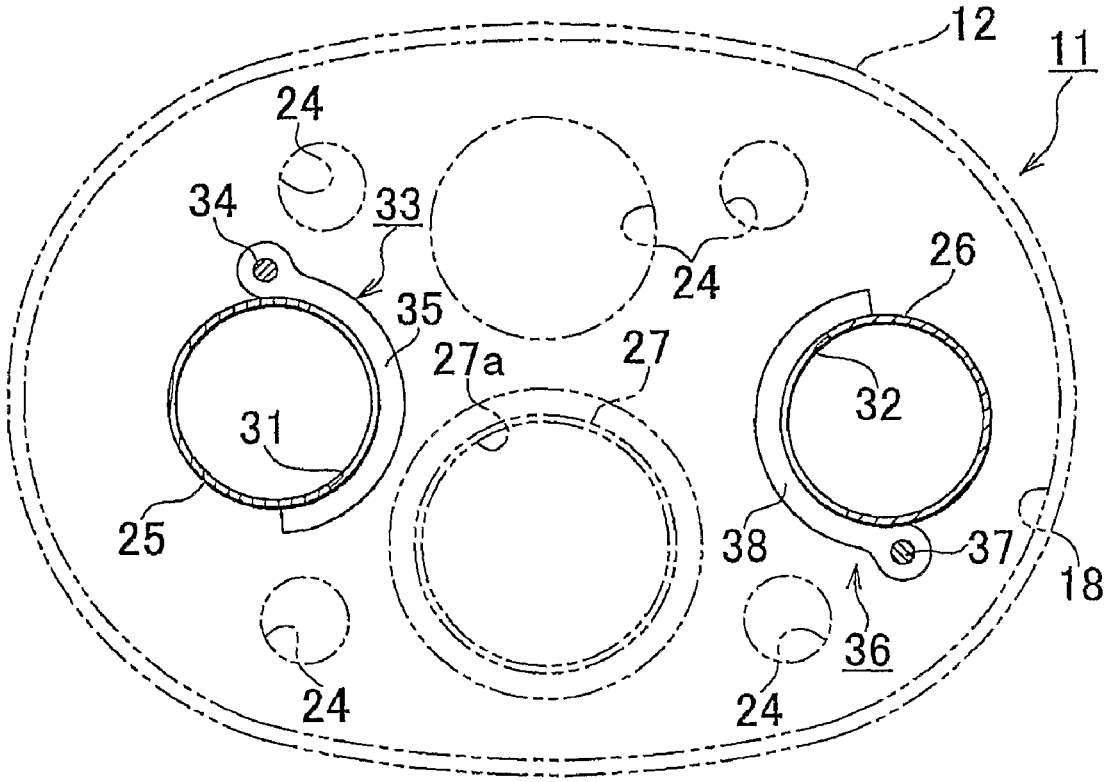
FIG. 6 is a partial cross-sectional view showing the positional relationship between the apertures for each inlet pipe and the valves in a second embodiment of the present invention.

The foregoing arrangement provides a considerable effect of suppressing exhaust interference (to be described below). Because of this, the positions of the apertures 31, 32 in the inlet pipes 25, 26 need not be set to locations at which exhaust interference does not occur as strictly as in the first embodiment. To clarify the difference between this and the first embodiment, in the second embodiment the apertures 31, 32 of the inlet pipes 25, 26 are provided at locations where the apertures 31, 32 directly face each other. In a condition in which the inlet pipes 25, 26 are disposed at a distance from each other in the vehicle width direction (left-to-right in FIG. 6), because of this positional relationship the above-noted locations of the apertures 31, 32 are intrinsically determined. As shown in FIG. 6, one aperture 31 is provided substantially on the right-hand semicircle of the first inlet pipe 25 when the plane perpendicular to the exhaust flow direction is viewed from downstream. In contrast, the other aperture 32 is provided substantially on the left-hand semicircle of the second inlet pipe 26 when the plane perpendicular to the exhaust flow direction is viewed from downstream. With this change in the positions of the apertures 31, 32 the positions of the valves 35, 38 also change.

Figure 7:
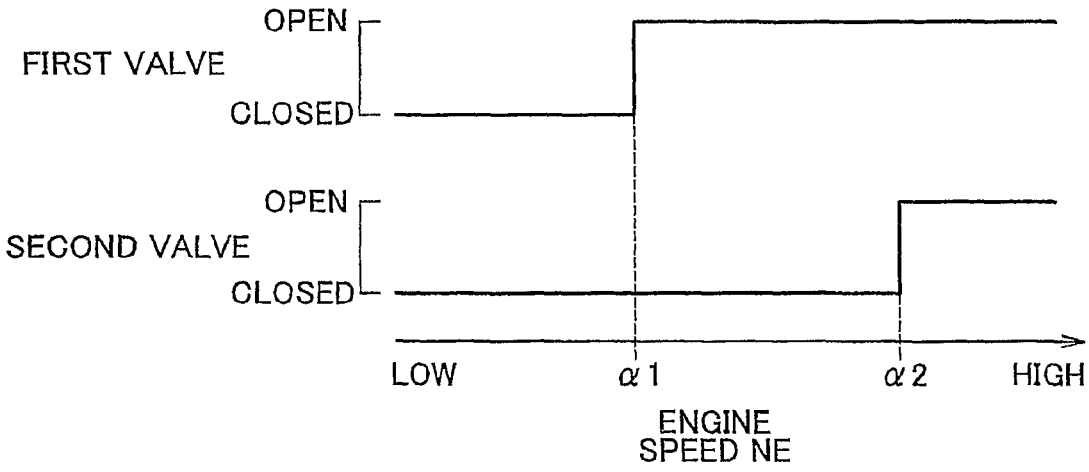
FIG. 7 is a drawing showing the relationship between the engine speed and the operating condition of each valve.

Because other elements of the second embodiment are the same as in the first embodiment, members and locations that are the same as in the first embodiment are assigned the same reference numerals and are not described herein. In the second embodiment constituted as noted above, exhaust flowing into the inlet pipes 25, 26 flows through different flow passages in response to the operating conditions operating condition of the valves 35, 38. The valves 35, 38, in response to the engine speed Ne, operate (open and close) in accordance with the relationship between the engine speed Ne and the threshold values $\alpha$1 and $\alpha$2 as shown in FIG. 7.

When the engine speed Ne is lower than the threshold value $\alpha$1, the exhaust flow amount from the engine is small, the exhaust pressure is low, and the urging force of the exhaust is smaller than that of the spring. For this reason, both the valves 35 and 38 are closed, and both the apertures 31 and 32 are in the blocked condition, the result being that the exhaust does not from out into the expansion chamber 18 from the apertures 31, 32.

As shown in FIG. 1, exhaust supplied in the inlet pipes 25, 26, in the same manner as in the first embodiment, flows into the resonance chamber 21 and exhaust also flows out from the holes 28 into the expansion chamber 20. The latter exhaust, after flowing upstream from the expansion chamber 20 to the expansion chambers 19, 18, 17, flows into the outlet pipe 27 from the inflow port 27*a*. The exhaust is guided by outlet pipe 27, and is guided to the exhaust passage downstream from the casing 12. In this flow passage, because of a change in volume (expansion) when passing through the expansion chambers 20, 19, for example, the pressure of the exhaust decreases, and the exhaust noise is reduced.

When the engine speed Ne reaches or exceeds the threshold value $\alpha$2, the exhaust flow amount is large, the exhaust pressure is high, and the urging force of the exhaust is greater than that of either spring. The valves 35, 38 are opened, resulting in both apertures 31 and 32 being open, the exhaust being able to flow out from the apertures 31, 32 into the expansion chamber 18.

For this reason, a part of the exhaust supplied in the inlet pipes 25, 26, in the same manner as in the first embodiment, after flowing in sequence through the holes 28, the expansion chamber 20, the expansion chamber 19, and then the outlet pipe 27, is guided out toward the exhaust path downstream from the casing 12. Another part of the exhaust, after flowing in sequence from the apertures 31, 32, through the expansion chamber 18, the expansion chamber 19, and then through the outlet pipe 27, is guided out toward the exhaust path downstream from the casing 12.

Figure 8:
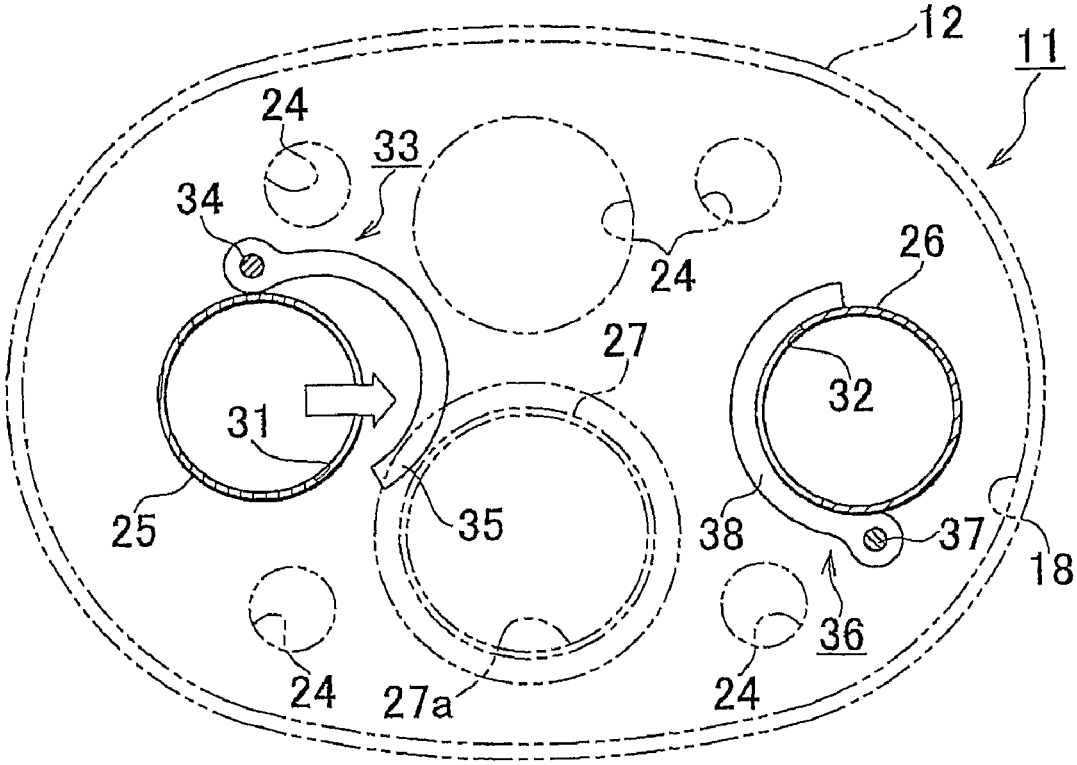
FIG. 8 is a partial cross-sectional view showing the condition in which only the first valve in FIG. 6 is open.

When the engine speed Ne reaches or exceeds the threshold value $\alpha$1 and also is less than threshold value $\alpha$2, the urging force of the exhaust is at least as large as that of the spring of the first opening/closing mechanism 33, and is smaller than that of the second opening/closing mechanism 36. For this reason, as shown in FIG. 8, the first valve 35 is opened to place the aperture 31 in the open condition, enabling the exhaust to flow out from the aperture 31 to the expansion chamber 18. The second valve 38 is closed to block the aperture 32, so that the exhaust does not flow out from the aperture 32

As shown in FIG. 1, a part of the exhaust supplied in the first inlet pipe 25, after flowing in sequence through the holes 28, the expansion chamber 20, the expansion chamber 19, and then the outlet pipe 27, is guided out toward the exhaust path downstream from the casing 12. Another part of the exhaust, after flowing in sequence through the aperture 31, the expansion chamber 18, the expansion chamber 19, and then the outlet pipe 27, is guided out toward the exhaust path downstream from the casing 12.

A part of the exhaust that is supplied in the inlet pipe 26 after flowing in sequence through the holes 28, the expansion chamber 20, the expansion chamber 19, and then the outlet pipe 27, is guided out toward the exhaust path downstream from the casing 12. Another part of the exhaust, flows from a downstream side end of the second inlet pipe 26 into the resonance chamber 21, and flows in the exhaust upstream direction from the downstream side end of the second inlet pipe 26 toward the first inlet pipe 25 in which the first valve 35 is opened. This exhaust flows out from the holes 28 into the expansion chamber 20 or from the aperture 31 into the expansion chamber 18.

In the foregoing exhaust flow passage from the second inlet pipe 26 to the resonance chamber 21 and then the first inlet pipe 25, the resonance chamber 21 also functions as an expansion chamber. Because of the change in volume (expansion)

of the exhaust when it passes through this flow passage, the exhaust pressure is reduced, and the exhaust noise is reduced (the sound-muffling effect is increased).

When the engine speed Ne is as noted above ($\alpha 1 \leqq Ne \leqq \alpha 2$), the second valve 38 is closed and the first valve 35 is open, as shown in FIG. 8. In this condition, although a part of the exhaust flowing in the first inlet pipe 25 flows out from the aperture 31 into the expansion chamber 18, the exhaust flowing in the second inlet pipe 26 does not flow from the aperture 32 into the expansion chamber 18. When this occurs, it is difficult for interference to occur between the exhaust flow from the aperture 31 and the exhaust flow from the aperture 32.

When the engine speed Ne changes (increases or decreases), the valves 35, 38 operate (open and close) as follows. For example, when both the valves 35 and 38 of the apertures 31 and 32 are closed, if the engine speed Ne increases, thereby raising the exhaust pressure, first the valve 35, which is urged by the elastic body (spring) having a small coefficient of elasticity k1, switches to the opened condition. After that, the second valve 38, which is urged by the elastic body (spring) having a large coefficient of elasticity k2, is switched to the opened condition.

In reverse, when both the valves 35 and 38 of the apertures 31 and 32 are open, if the engine speed Ne decreases, thereby reducing the exhaust pressure, first the second valve 38, which is urged by the elastic body (spring) having the large coefficient of elasticity k2, switches to the closed condition. After that, the first valve 35, which is urged by the elastic body (spring) having the small coefficient of elasticity k1, switches to the closed condition.

In either case, a period of time occurs during which one aperture 31 is open and the other aperture 32 is blocked. During this period of time, exhaust from the other aperture 32 does not flow out into the expansion chamber 18, and the exhaust from only the one aperture 31 flows out into the expansion chamber 18. Interference between the exhaust flows from the apertures 31, 32 is thus not likely to occur.

In addition to achieving the effect (4) as noted for the first embodiment, the second embodiment as described in detail above achieves the following effects (5) to (8). (5) Using a first valve 35 that switches operating condition at a different timing from that of the second valve 38, the first valve 35 is opened when the second valve 38 is closed. For this reason, during the above-noted period of time, although exhaust from the aperture 32 does not flow out into the expansion chamber 18, and the exhaust from the one aperture 31 can flow out into the expansion chamber 18, enabling suppression of the problem of interference between the flows of exhaust from the apertures 31, 32 and the occurrence of an accompanying abnormal sound. Along with this, it is possible to suppress the problem of the abnormal sound hindering the sound-muffling effect of the muffler 11.

(6) In the muffler 11 having a plurality of inlet pipes 25, 26, apertures 31, 32 are provided in the pipe walls of the inlet pipes 25, 26, these apertures 31, 32 forming a plurality of apertures. By opening the apertures 31, 32 by opening the valves 35, 38, exhaust flowing midway in the inlet pipes 25, 26 is caused to flow out into the expansion chamber 18 from the apertures 31, 32.

Even in this type of muffler 11, therefore, by using a first valve 35 that switches operating condition at a different timing than the second valve 38, it is possible to solve the problem of an abnormal sound accompanying interference between exhaust from the apertures 31, 32.

(7) Elastic bodies (springs) having different coefficients of elasticity k1, k2 are used as the elastic bodies (springs) for the valves 35, 38. For this reason, even if, when both of the valves 35 and 38 are closed, the exhaust pressure rises with an increase in the engine speed Ne, and even if, when both of the valves 35 and 38 are open, the exhaust pressure decreases with a decrease in the engine speed Ne, it is possible to open the aperture 31 and also to block the aperture 32. It is possible to cause exhaust from only the aperture 31 to flow out into the expansion chamber 18 without causing the exhaust from the aperture 32 to flow out into the expansion chamber 18.

In this manner, with a simple configuration using elastic bodies (springs) having different coefficients of elasticity k1 and k2, it is possible to switch the operating condition of the first valve 35 at a different timing to suppress the occurrence of abnormal sound caused by interference between the flows of exhaust from the apertures 31, 32.

(8) In addition to the condition in which both of the valves 35 and 38 are open and the condition in which both of the valves 35 and 38 are closed, a condition can occur in which only the first valve 35 is open (the second valve 38 being closed). In the condition in which only the first valve 35 is open, with regard to the exhaust flowing into the resonance chamber 21 from the inlet pipes 25, 26, the force of the exhaust impacting on the resonance chamber 21 is different than in other embodiments. Along with this, the resonant frequency also is different, and the engine speed region at which the sound pressure of the resonant sound is maximum is also different. This rotational speed region shifts to a higher rotational speed region that than that of the case in which both the first valve 35 and the second valve 38 are closed, enabling suppression of the sound pressure of the resonant sound in a low rotational speed region. In this manner, the aspect of opening only the first valve 35 improves the degree of freedom in designing the muffler 11, and improves the sound-muffling performance.

The present invention can be implemented as yet another embodiment, as will now be described. The features of the second embodiment may be added to the first embodiment. Specifically, in addition to providing the apertures 31, 32 at locations in the inlet pipes 25, 26 that they do not face each other, the timing of switching of the operating conditions of the valves 35, 38 is made at different times. This makes possible more reliable suppression of interference between the flows of exhaust from the apertures 31, 32.

In order to achieve the foregoing, for example, elastic bodies (springs) for the valves 35, 38 may have different coefficients of elasticity k1 and k2. According to this, even if, when both of the valves 35 and 38 are in the closed condition, the engine speed Ne is increasing, accompanied by a rise in the exhaust pressure and, in the reverse, if, when both of the valves 35 and 38 are in the open condition, the engine speed Ne decreases, accompanied by a decrease in the exhaust pressure, a period of time occurs during which the aperture 31 is open and the aperture 32 is blocked. During this period of time, exhaust from the other aperture 32 does not flow out into the expansion chamber 18, and the exhaust from only the one aperture 31 flows out into the expansion chamber 18.

Therefore, the use of elastic bodies (springs) having different coefficients of elasticity k1, k2, as noted above, makes it possible to make it difficult for interference to occur between the exhaust flow from the aperture 31 and the exhaust flow from the aperture 32 and, compared to the case in which the valves 35 and 38 switch operating conditions at the same time (corresponding to the first embodiment), more reliable suppression of exhaust interference is achieved.

The valves 35, 38 may be driven by a dedicated actuator, in which case, in contrast to the case of using elastic bodies (springs), the valves 35, 38 can be opened and closed without regard to the exhaust flow amount (exhaust pressure).

In the first embodiment the operating conditions of the valves 35, 38 are switched with the same timing. For this reason, if the above-noted actuator is applied to the first embodiment, actuators for each of the valves 35 and 38 may be used to open and close the valves 35 and 38. A single actuator may also be used to open and close both of the valves 35, 38. In the latter case, a transmission mechanism that transmits the actuation of the actuator to each of the valves 35, 38 at the same time is required.

In contrast to this, in the second embodiment the operating conditions of the valves 35, 36 are switched with different timing. For this reason, if the above-noted actuator is applied to the second embodiment, actuators for each of the valves 35 and 38 are used to operate (open and close) the valves 35 and 38.

In this case, the valves 35, 38 may be operated (opened and closed) so that there is no overlap between the period of time during which the first valve 25 is open and the period of time during which the second valve 38 is open. According to this, because there is no overlap between the period of time during which the first valve 25 is open and the period of time during which the second valve 38 is open, when the first valve 35 is open the second valve 38 is closed, and when the second valve 38 is open the first valve 35 is closed. For this reason, a relationship exists in which, when the exhaust from the one aperture 31 flows out into the sound-muffling chamber (expansion chamber 18), the exhaust from the other aperture 32 does not flow out into the sound-muffling chamber. The reverse relationship can also occur. Therefore, regardless of the positional relationship of apertures 31 and 32, even if the apertures 31, 32 are at mutually opposing positions, for example, it is difficult for the phenomenon to occur in which the exhaust flowing out from the aperture 31 interferes with the exhaust flowing out from the aperture 32. It is thus possible to achieve the effect of suppressing interference between the exhaust flows from the apertures 31, 32 over the entire range of engine speed Ne.

The present invention is widely applicable to mufflers, if the space within the casing 12 is partitioned into a plurality of (two or more) sound-muffling chambers by separators. The shape of the apertures 31, 32 may be different from that in the first embodiment, for example, a polygonal shape other than a substantially rectangular shape, circular, or elliptical. In this case, all the apertures 31, 32 may have the same shape, or may have different shapes.

The apertures may have one hole as in the above-noted embodiments, and alternatively may have a collection of a plurality of small holes. In opening and closing the apertures 31, 32, the valves 35, 38 may operate differently from the above-noted embodiments, in which the valves swing about the shafts 34, 37 as a pivot point.

A spring other than a coil spring may be used as the above-noted torsion coil spring. The muffler of the present invention may be provided in an exhaust system other than that of a vehicle engine. The exhaust pipes provided with the apertures 31, 32 are not restricted to the inlet pipes 25, 26, and may be the outlet pipe 27.

In the case noted below, both the inlet pipes 25, 26 and the outlet pipe 27 are taken as being included when the term exhaust pipe is used. The present invention can be applied to a muffler 12 in which three or more exhaust pipes pass through a plurality of sound-muffling chambers in the casing 12.

Figure 9:
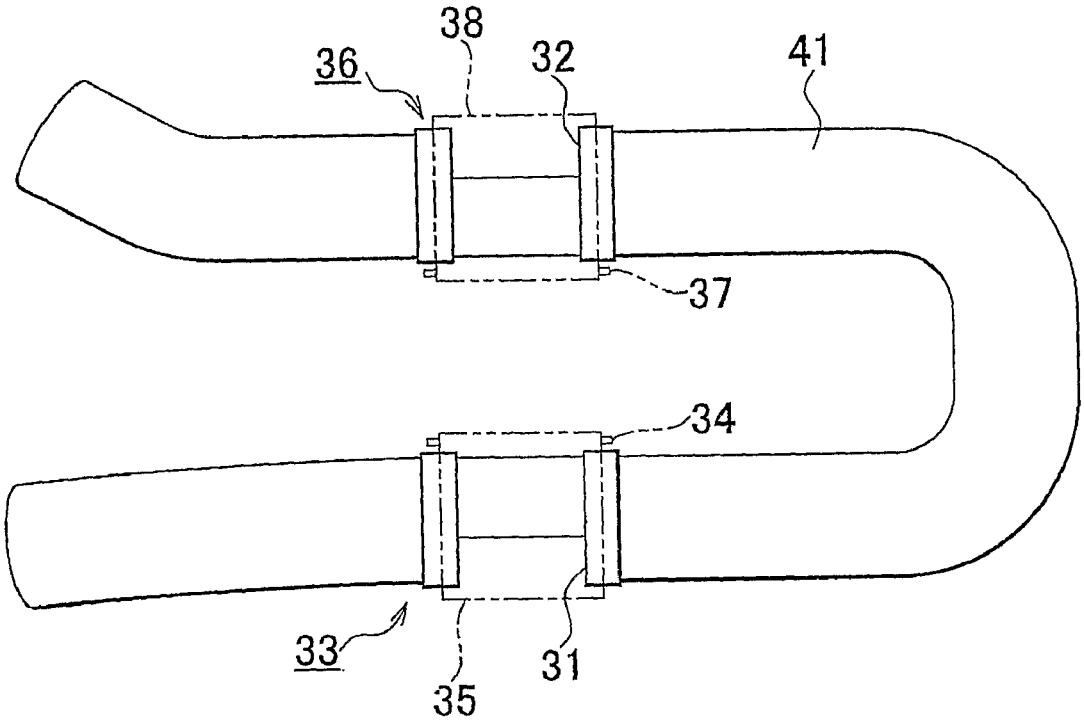
FIG. 9 is a drawing showing the positional relationship between the apertures in another embodiment in which two apertures are provided in one and the same exhaust pipe.

The present invention can be applied to a muffler in which a plurality of apertures are provided in each exhaust pipe. For example, as shown in FIG. 9, in the case in which the exhaust pipe 41 is disposed in the casing so that it folds back midway, the apertures 31, 32 may be provided at locations in the pipe walls of the exhaust pipe 41 which do not face each other.

The plurality of apertures may be three or more provided in each exhaust pipe. In this case, the apertures are provided at locations such that the exhaust flowing out from one aperture does not interfere with the exhaust flowing out from the other apertures.

The invention claimed is:

1. A muffler comprising:

a plurality of sound-muffling chambers enclosed in a casing;

an exhaust pipe that passes through at least two of the plurality of sound-muffling chambers and to pass through exhaust from an engine;

first and second apertures provided in the exhaust pipe that open into one of the plurality of sound-muffling chambers, the one sound-muffling chamber being the same for the first and second apertures; and a valve, provided at each aperture;

wherein the first and second apertures are provided at the locations where an exhaust flow from the first aperture and an exhaust flow from the second aperture do not interfere with each other.

2. The muffler according to claim 1, wherein the first aperture is oriented so that it does not directly face the second aperture.

3. The muffler according to claim 1, wherein elastic bodies are used to close the valves.

4. The muffler according to claim 3, wherein elastic bodies are used to close the valves, and each elastic body used to close its respective valve of the plurality of valves has a different coefficient of elasticity.

5. A muffler characterized by comprising:

a plurality of sound-muffling chambers enclosed in a casing;

an exhaust pipe that passes through at least two of the plurality of sound-muffling chambers and to pass through exhaust from an engine;

a plurality of apertures, provided in the exhaust pipe, that open into one of the plurality of sound-muffling chambers, the one sound-muffling chamber being the same for the plurality of apertures; and first and second valves, each of which is provided at each aperture;

wherein a first valve and a second valve open or close at different times.

6. The muffler according to claim 5, wherein the time period over which the first valve is open does not overlap with the time period that the second valve is open.

7. The muffler according to claim 5, wherein elastic bodies are used to close the valves.

8. The muffler according to claim 7, wherein elastic bodies are used to close the valves, and each elastic body used to close its respective valve of the plurality of valves has a different coefficient of elasticity.

9. A muffler comprising:

a plurality of sound-muffling chambers enclosed in a casing;

a plurality of inlet exhaust pipes that pass through at least two of the plurality of sound-muffling chambers and to pass through exhaust from an engine;

an aperture provided in each inlet exhaust pipe that opens into one of the plurality of sound-muffling chambers, wherein each aperture opens into the same sound-muffling chamber; and a valve, provided at each aperture;

wherein the plurality of apertures are provided at the locations where an exhaust flow from a first aperture of the plurality of apertures and an exhaust flow from a second aperture of the plurality of apertures do not interfere with each other.

10. The muffler according to claim 9, wherein the first and second apertures are oriented so that the first and second apertures do not directly face each other.

11. A muffler comprising:

a plurality of sound-muffling chambers enclosed in a casing;

a plurality of exhaust pipes that pass through at least two of the plurality of sound-muffling chambers and to pass through exhaust from an engine;

an aperture provided in each exhaust pipe that opens into one of the plurality of sound-muffling chambers, wherein each aperture opens into the same sound-muffling chamber; and a plurality of valves, provided at each aperture;

wherein a first valve and a second valve of the plurality of valves open or close at different times.

12. The muffler according to claim 11, wherein the time period over which the first valve is open does not overlap with the time period that the second valve is open.

13. A muffler comprising:

a plurality of sound-muffling chambers, enclosed in a casing;

at least one exhaust pipe that passes through at least two of the plurality of sound-muffling chambers; chambers, each exhaust pipe having a portion within a sound-muffling chamber;

an aperture, provided in each portion of the at least one exhaust pipe present in one of the plurality of sound-muffling chambers, wherein each aperture opens into the same sound-muffling chamber; and a valve, provided at each aperture, wherein the plurality of apertures are provided at the locations where an exhaust flow from a first aperture of the plurality of apertures and an exhaust flow from a second aperture of the plurality of apertures do not interfere with each other.

14. The muffler according to claim 13, wherein the first and second apertures are oriented so that the first and second apertures do not directly face each other.

15. A muffler comprising:

a plurality of sound-muffling chambers, enclosed in a casing;

at least one exhaust pipe that passes through at least two of the plurality of sound-muffling chambers, each exhaust pipe having a portion within a sound-muffling chamber;

an aperture, provided in each portion of the at least one exhaust pipe present in one of the plurality of sound-muffling chambers, wherein each aperture opens into the same sound-muffling chamber; and a valve, provided at each aperture, wherein a first valve and a second valve of the plurality of valves are not opened or closed simultaneously.

16. The muffler according to claim 15, wherein the time period over which the first valve is open does not overlap with the time period that the second valve is open.

* * * * *